US005421699A

United States Patent [19]

Guiles et al.

[11] Patent Number: 5,421,699

[45] Date of Patent: Jun. 6, 1995

[54] METHOD AND APPARATUS FOR MERGING VERTICAL DOCUMENTS WITH HORIZONTAL DOCUMENTS

[75] Inventors: Joseph Guiles, Prospect; Irena Makarchuk, Fairfield; Scott W. Martin, Seymour; James Morabito, Bethel; William D. Toth, Milford, all of Conn.

[73] Assignee: Pitney Bowes Inc., Stamford, Conn.

[21] Appl. No.: 276,683

[22] Filed: Jul. 18, 1994

Related U.S. Application Data

[63] Continuation of Ser. No. 998,291, Dec. 30, 1992, abandoned.

[51] Int. Cl.[6] ..... B65H 39/06

[52] U.S. Cl. ..... 414/788; 414/786; 271/98; 271/184; 271/233; 270/58

[58] Field of Search ..... 271/9, 184, 225, 240, 271/233; 414/789.6, 791.1; 270/52, 58

[56] References Cited

U.S. PATENT DOCUMENTS

| | | | |
|---|---|---|---|
| 3,360,099 | 12/1967 | Barr | 271/184 |
| 3,936,993 | 2/1976 | Dorer | 271/184 |
| 4,049,256 | 9/1977 | Church et al. | 271/233 |
| 4,387,890 | 6/1983 | Lampe | 271/184 |
| 4,696,464 | 9/1987 | Gammerler | 271/9 |
| 4,757,903 | 7/1988 | Edin | 271/184 |
| 4,903,591 | 2/1990 | Nobile | 271/259 |
| 5,031,891 | 7/1991 | Kobler et al. | 270/58 |
| 5,100,125 | 3/1992 | Uplinger | 271/233 |
| 5,131,645 | 7/1992 | Riccardi | 271/184 |
| 5,141,216 | 8/1992 | Ballestrazzi et al. | 271/9 |
| 5,147,092 | 9/1992 | Driscoll et al. | 271/184 |
| 5,294,101 | 3/1994 | Scheufler | 271/9 |

*Primary Examiner*—Michael S. Huppert
*Assistant Examiner*—Gregory A. Morse
*Attorney, Agent, or Firm*—Robert H. Whisker; Melvin J. Scolnick

[57] ABSTRACT

Apparatus and a method for merging vertically oriented documents with horizontally oriented documents. The apparatus includes: a document assembler for receiving vertically oriented documents, the document assembler having a pair of parallel paper paths, wherein each of the paper paths includes a device for transporting the vertically oriented documents and a device for stopping and a device for aligning the vertically oriented documents; a device located beneath the document assembler for re-orienting the documents from the document assembler in a vertical orientation to a horizontal orientation; and a horizontal transport located beneath the re-orienting device for feeding horizontally oriented documents toward the re-oriented documents emerging from the re-orienting device, whereby the horizontally oriented documents are merged with the re-oriented documents from the document assembler.

7 Claims, 6 Drawing Sheets

12
72
70
73
71
74
76
32
34
62
38
14
36
64
30
28
40
66
44
16
42
68
26

90
92
49
52
56
54
50
60
58
53
12
42
36
16
14
42
34
48
46
28
30

26
28
30
32
34
36
40
42
46
48
49
50
52
53
54
56
58
60
14
16

METHOD AND APPARATUS FOR MERGING VERTICAL DOCUMENTS WITH HORIZONTAL DOCUMENTS

This application is a continuation of application Ser. No. 07/998,291, filed Dec. 30, 1992, now abandoned.

BACKGROUND OF THE INVENTION

The instant invention relates to merging collations of documents, and more particularly to merging a collation of documents which is oriented vertically (on edge) with a collation of documents which is oriented horizontally.

Inserting equipment is utilized for collating and inserting various documents into an envelope. Typically, feeders deposit documents onto a moving conveyor belt, and the various documents are collected, aligned and inserted into an envelope. Conventionally, the feeders are situated along a single path. There are applications, however, which utilize two paths of documents in which the paths are oriented at right angles to each other, and one of the paths handles documents oriented horizontal to ground and the other path handles documents which are oriented vertically to ground, i.e., they are transported on their edge. In such a case, it becomes necessary to align the documents and to turn the vertical documents from their edge onto a horizontal plane so that the vertical documents can be merged with the horizontal documents and inserted into an envelope.

The marketplace today requires that documents be processed as rapidly as possible, and it should be apparent that the process of aligning and turning documents prior to their being merged with other documents is a time consuming process. Accordingly, the instant invention provides a method and apparatus for accurately aligning and turning vertically oriented documents and merging them with horizontally oriented documents in the minimum possible amount of time so that throughput is maximized.

SUMMARY OF THE INVENTION

Accordingly, the instant invention provides apparatus for merging vertically oriented documents with horizontally oriented documents. The apparatus comprises: a document assembler for receiving vertically oriented documents, the document assembler having a pair of parallel paper paths, wherein each of the paper paths includes means for transporting the vertically oriented documents and means for stopping and aligning the vertically oriented documents; means located beneath the document assembler for re-orienting the documents from the document assembler in a vertical orientation to a horizontal orientation; and a horizontal transport located beneath the re-orienting means for feeding horizontally oriented documents toward the re-oriented documents emerging from the re-orienting means, whereby the horizontally oriented documents are merged with the re-oriented documents from the document assembler.

The instant invention also provides a method of merging vertically oriented documents with horizontally oriented documents. The method comprises: feeding vertically oriented documents to a document assembler having a pair of parallel paper paths; feeding the vertically oriented documents alternately through said pair of parallel paper paths; stopping the vertically oriented documents at the end of the paper paths; aligning the vertically oriented documents at the end of the paper paths dropping the aligned, vertically oriented documents below said paper path; re-orienting the vertically oriented documents to a horizontal orientation; and feeding horizontally oriented documents toward the re-oriented documents to merge the horizontal documents with the re-oriented documents.

DETAILED DESCRIPTION OF THE PREFERRED EMBODIMENT

Figure 1:
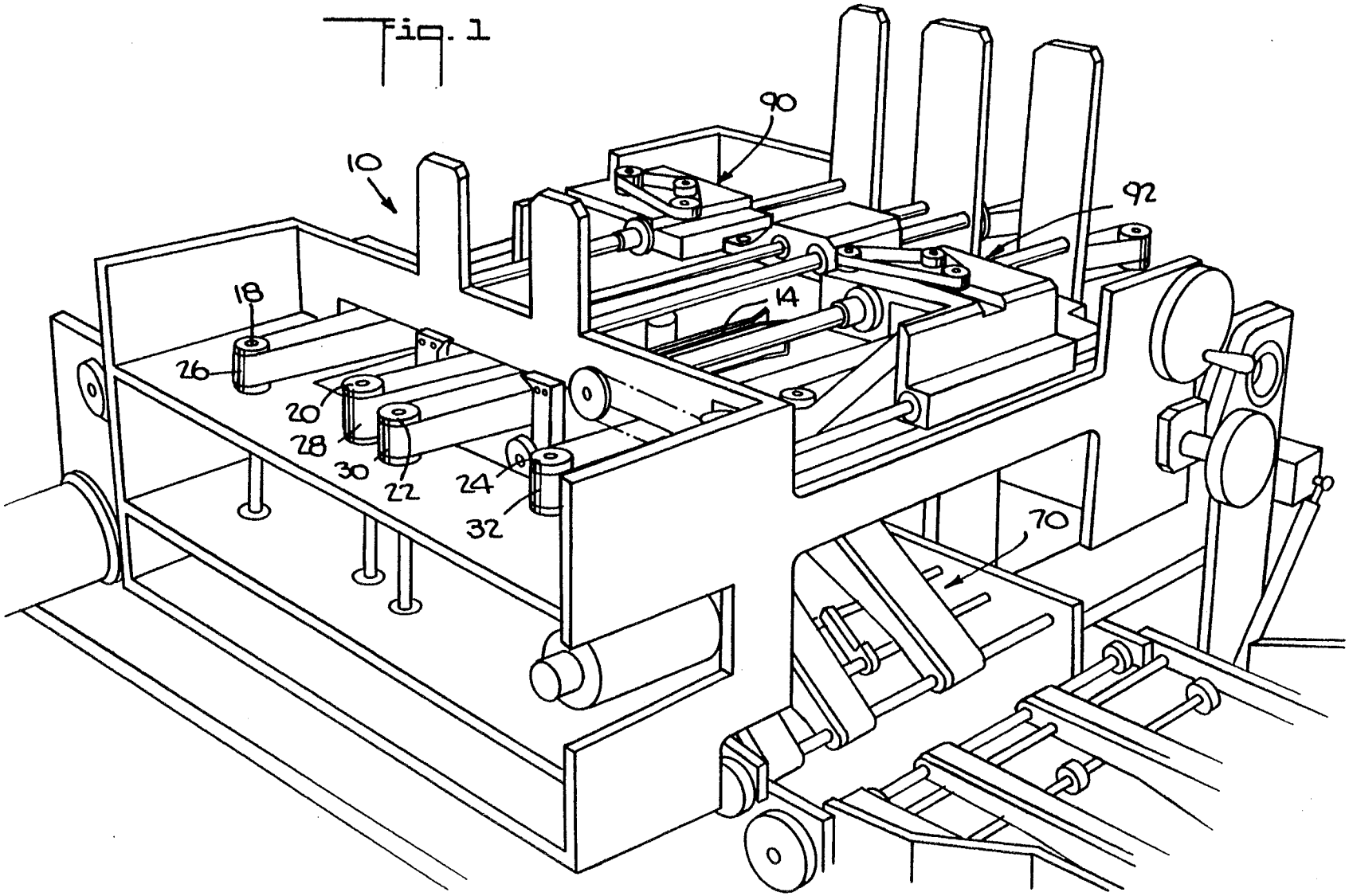
FIG. 1 is a perspective view of apparatus for turning and aligning two sets of documents lying in perpendicular planes in accordance with the instant invention.
Figure 4:
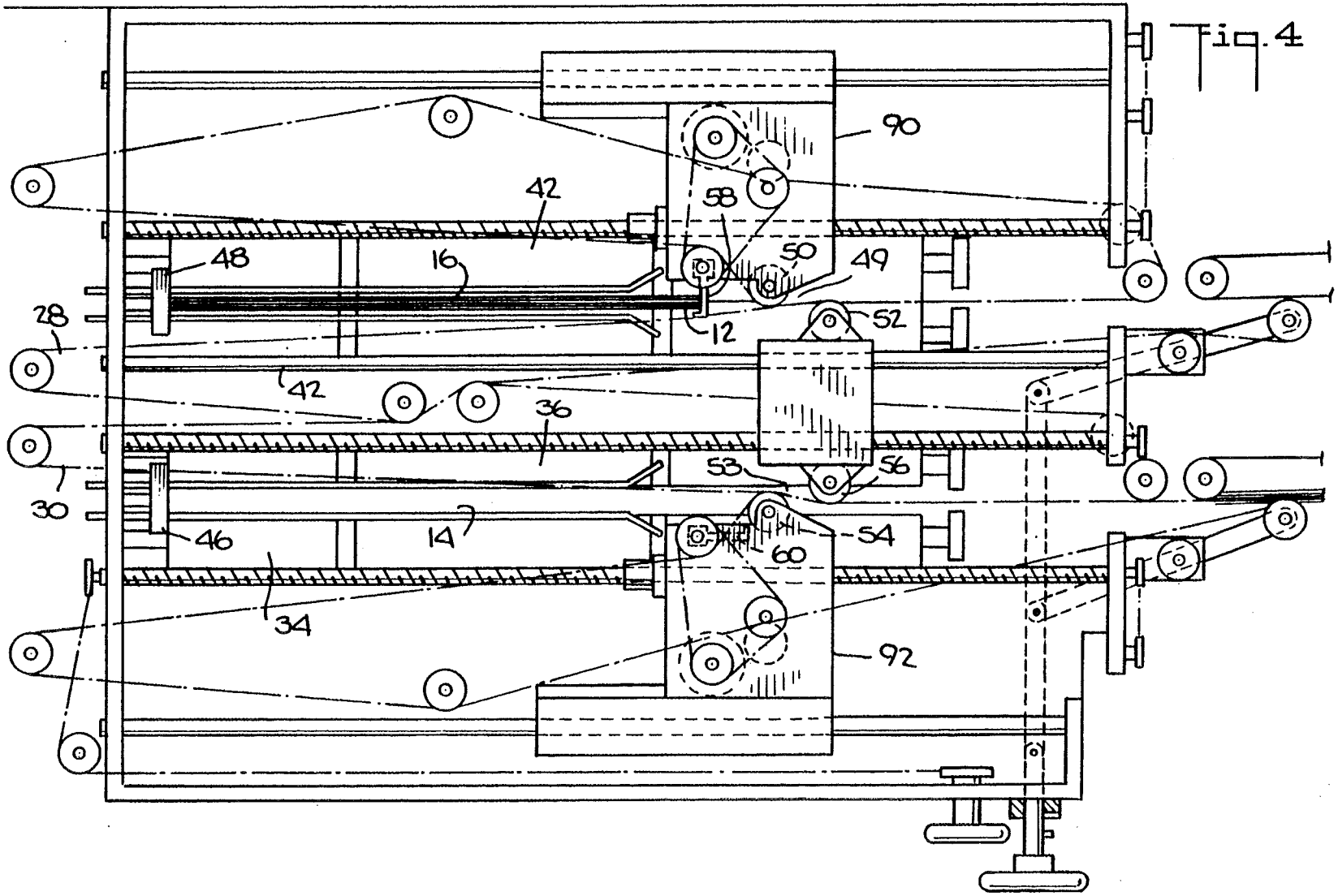
FIG. 4 is a top, plan view of the apparatus for feeding the vertical documents along two, parallel paper paths prior to the vertical documents being turned to a horizontal orientation.
Figure 5:
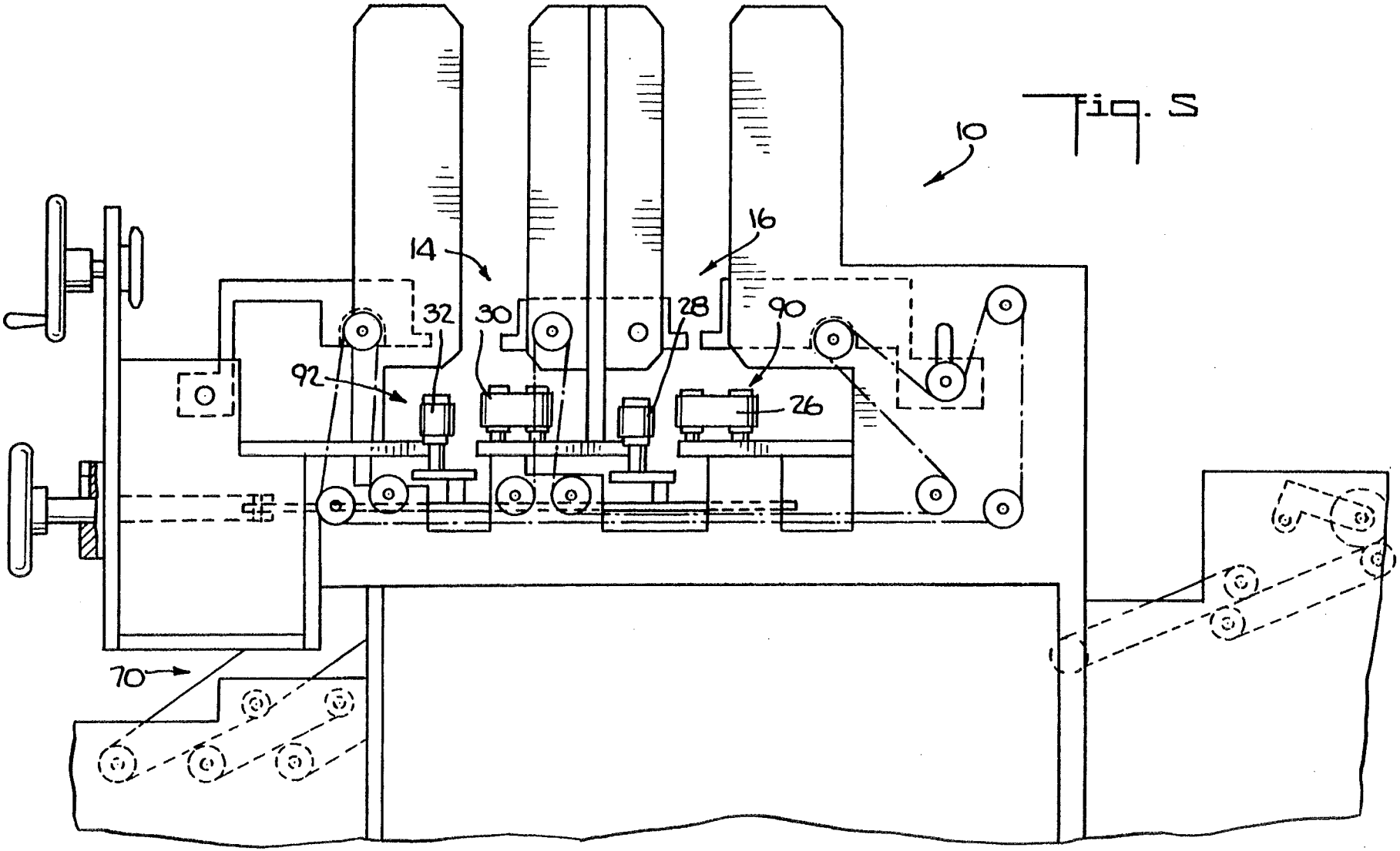
FIG. 5 is a rear, elevational view of the apparatus seen in FIG. 1.
Figure 6:
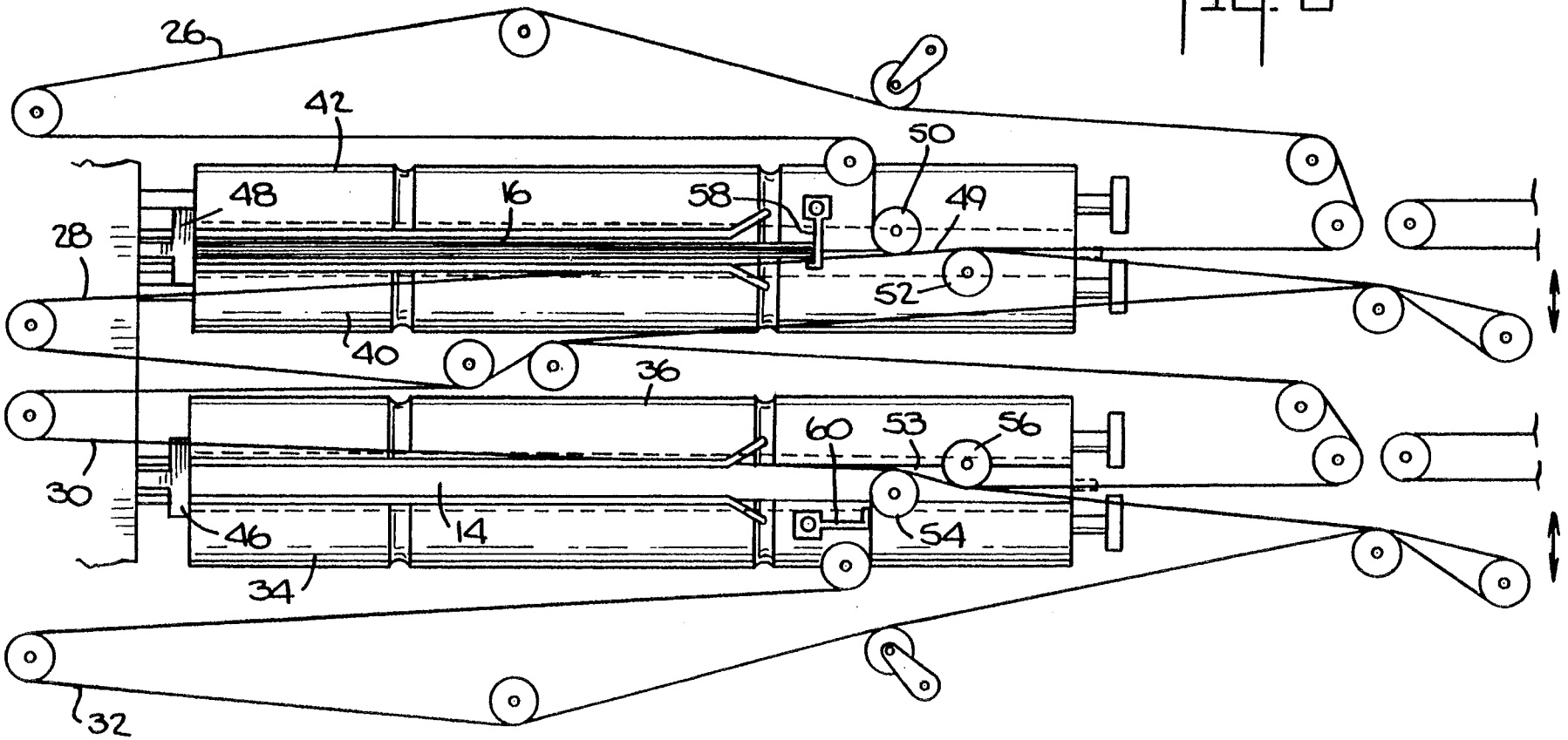
FIG. 6 is a simplified, top, plan view of the apparatus seen in FIG. 4 showing the vertical documents after they have been aligned.

In describing the preferred embodiment of the instant invention, reference is made to the drawings, wherein there is seen a document assembler 10 which accepts documents 12 such as pre-printed inserts (typically advertising material) in a vertical orientation (on edge) from an upstream paper transport (not shown), which, looking at FIG. 4, would be located to the right of the document assembler 10 shown therein. The documents 12 are delivered to two parallel pockets 14 and 16 of the assembly 10 by a vertical drive system consisting of four drive pulleys, 18, 20, 22 and 24 (see FIG. 1) which support and drive, respectively four flat, endless belts 26, 28, 30 and 32. As best seen in FIG. 6, the upstream (right) ends of the belts 26 and 28 form one receiving aperture for the documents 12 and the belts 30 and 32 form a second receiving aperture for the documents 12 coming from the upstream paper transport located to the right of the assembly 10 seen in FIG. 6.

The pocket 14 is defined by a pair of D-shaped, compliant, nip rollers 34 and 36 (see FIG. 7) and a pivotable, horizontal floor 38. The pocket 16 is defined by a pair of D-shaped, compliant rollers 40 and 42 and a pivotable, horizontal floor 44. The belts 26, 28, 30 and 32 transfer the documents from the paper transport and maintain control of the documents 12 while they are being delivered to the pockets 14 and 16 of the assembly 10.

The driving belts 26, 28, 30 and 32 are positioned above the nip rollers 34 and 36 in such a way that the longest of the documents 12 reaches the end of the pocket 14 or 16 and hits the backstop 46 or 48 respectively. The driving belts 26 and 28 continue to drive the documents 12 up against the backstop 48 until they are clear of the drive nip 49 defined by the pulleys 50 and 52. Similarly, the driving belts 30 and 32 continue to drive the documents 12 up against the backstop 46 until they are clear of the drive nip 53 defined by the pulleys 54 and 56. Once the documents 12 reach the backstops 46 and 48, they are free of the drive nips 53 and 49 respectively and are positioned for realignment.

Documents 12 which arrive at the backstops 46 and 48 misregistered are repositioned as they are driven up against the backstops 46 and 48 from the vertical drive nips 49 and 53. As the trailing edge of the document 12 passes a pocket entry sensor (not shown) an encoder count delay off the vertical drive motor encoder (not shown) is activated. The encoder delay allows for response time for a pair of retainment fingers 58 and 60 to follow in behind the trailing edge of the documents 12. The primary function of the retainment fingers 58 and 60 is to contain the bounce back energy of the documents 12 as they impact the backstops 48 and 46 respectively. The retainment fingers 58 and 60 are positioned a critical distance from the vertical drive nips 49 and 53 respectively to assure that the documents 12 are clear of the nips 49 and 53 when they are being contained by the fingers 58 and 60. Also, the distance from the fingers 58 and 60 to the backstops 48 and 46 respectively provide the final alignment position of the documents 12 for subsequent insertion into an envelope (not shown). The backstops 46 and 48 are composed of a material which provides very low values of restitution which is critical for dampening the energy of the documents 12 as they impact the backstops 46 and 48, preventing bouncing of the documents 12. Controlling the document bounce back enhances the realignment control of the retainment fingers 58 and 60.

Immediately after the documents 12 have been realigned against the backstop 46 or 48, a small window of time is available to allow for settling of the documents 12, after which the nip rollers 34 and 36 or the nip rollers 40 and 42 are rotated a known distance to nip and provide a normal force on the documents 12, i.e. the D-shaped nip rollers are rotated so that the flats of the rollers are remote from the documents 12 and the round portion of the rollers engage the documents 12 for arming. As the edges of the D rollers contact the documents 12, a normal force is developed upon the collation of documents 12 by the holding torque of the motor (not shown) driving the nip rollers 34, 36, 40 and 42.

The preferred material for the nip rollers 34, 36, 40 and 42 is a closed cell, cellular foam elastomer, so that as the thickness of collations vary when being armed and accelerated through the nip rollers 34, 36, 40 and 42, no adjustments are required to process these collations. The "D" cutaway obviates the need for a mechanism to open and close the nip rollers to provide a paper path between the rollers.

The motion of the nip rollers 34, 36, 40 and 42 is controlled by a servo controlled, closed loop stepper motor (not shown). Although the motor is being displaced to a known position, its position and the amount of relative motion it places on the collation of documents can be controlled by sensing the back EMF forces generated as it presses on the documents 12 at a known velocity. By controlling the motor in this manner, a consistent normal force can be maintained on the documents 12 when they are being nipped. Also, for a known EMF force, the acceleration torque required for thicker collations of documents 12 can be adjusted to assure proper performance.

The nip rollers 34, 36, 40 and 42 have a section cut from them to give them edges 62, 64, 66 and 68 respectively which provide the "D" shape appearance. In the preferred embodiment, the edges 62, 64, 66 and 68 are bonded with an extruded material called ethylene propylene di-methylene (EPDM). However, other materials may also be used. The primary function of the EPDM is to act as an anti-scruff edge and assure a smooth paper flow route through the nip rollers 34, 36, 38 and 40 and up to the backstops 46 and 48. The EPDM material also provides a more positive edge for nipping or arming of the documents 12.

Figures 2, 7:
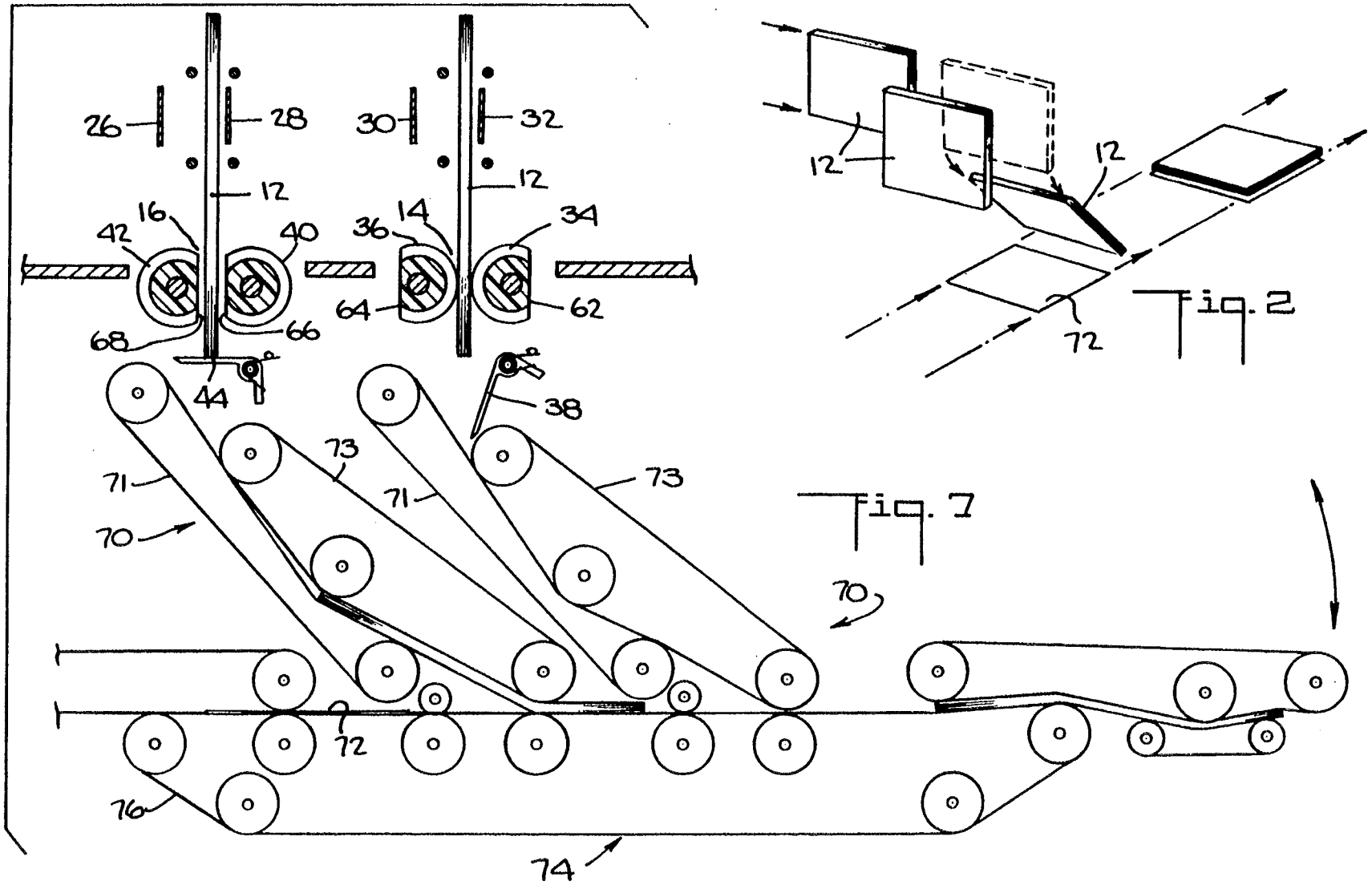
FIG. 2 is a schematic representation of the turning of the vertically oriented documents and the merging of the vertical documents with the horizontal documents in accordance with the method of the instant invention.
FIG. 7 is a side, elevational view of the apparatus seen in FIG. 1.
Figure 3:
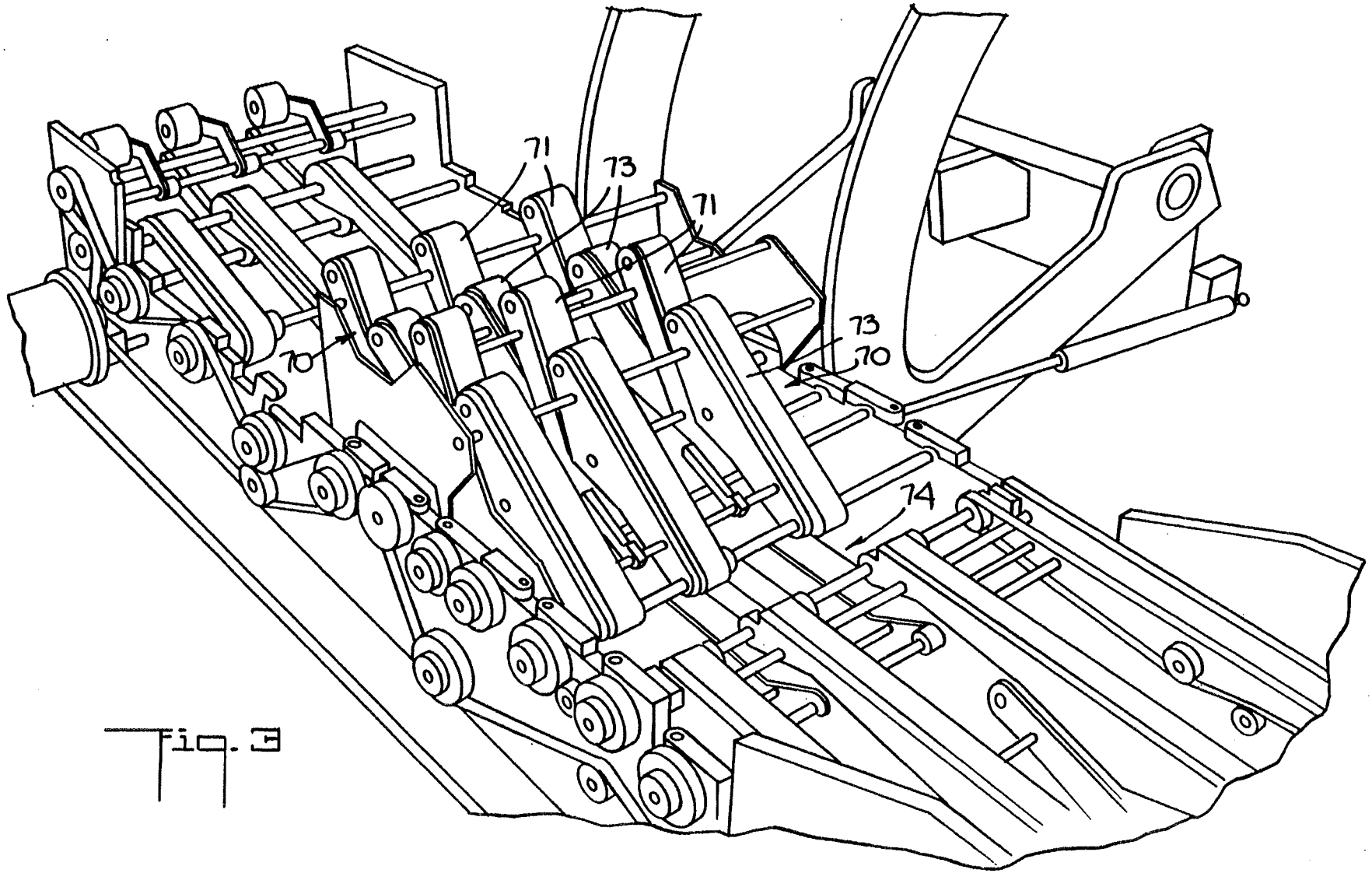
FIG. 3 is a perspective view of the apparatus for feeding the vertical and horizontal documents after they have been merged into a horizontal alignment.

As the documents 12 are being realigned and nipped for arming, the pivotable floors 38 or 44 are horizontal and maintain the documents 12 in the vertical direction until they are properly nipped by the rollers 34 and 36 or 40 and 42. Once armed (i.e. grabbed), the floor 38 or 44 is pivoted from one side of the pocket 14 or 16 respectively downward, as seen in FIG. 7, to provide a path toward a pair of snorkel transports generally designated 70 located beneath the floors 38 and 44. Each of the transports 70 consists of a pair of driven belts 71 and 73. The floor 38 or 44 is activated by a time delay from the arming position of the nip rollers 34 and 36 or 40 and 42 respectively. The floor 38 or 44 remains open until after the trailing edge of the documents 12 has passed the floor 38 or 44, which then closes to prepare for the arrival of the next documents 12 from the document assembler 10.

The documents 12 are accelerated from the nip rollers 34 and 36 or 40 and 42 to a matched velocity of the snorkel transports 70. Upon acquiring the documents 12, the snorkel transports 70 gradually transfer the documents 12 from a vertical orientation to a horizontal orientation as indicated in FIGS. 2 and 7, which is achieved by moving the documents 12 through a gentle, sloping radius as part of the design of the transports 70.

As the documents 12 from the vertical orientation are being delivered from the nip rollers 34 and 36 or 38 and 40 through one of the snorkel transports 70, another set of documents 72 (see FIG. 7) are on their way along a horizontal transport 74 consisting of modular segments of elastic transport belts 76. Documents 72 traveling along the horizontal transport 74 interrupt a sensor (not shown) mounted within the transport 74. At a predetermined delay from the transport motor encoder (not shown), documents 12 are delivered from the armed nip rollers 34 and 36 or 38 and 40 to merge with those documents 72 traveling along the horizontal transport 74.

The merge of the horizontal transport 74 with the snorkel transports 70 consists of two paths, one from each of the two nip roller pockets 14 and 16, which interface with the input sections of the horizontal transport 74. After the merge has occurred, the documents 12 and 72 are transported along the horizontal transport 74 in a horizontal orientation in the positive grip and control of the elastic belts 76. The horizontal transport 74 then delivers the collation of merged documents 12 and 72 to the interface with an inserting machine (not shown). At this handoff point, the collations of documents 12 and 72 have been realigned, redirected, and accurately merged, thereby enhancing the document preparation and delivery.

In order to accommodate various lengths of documents 12, the retainment finger 58 and the pulleys 50 and 52 are mounted on a translatable carriage 90. Similarly, the retainment finger 50 and the pulleys 54 and 56 are mounted on a second translatable carriage 92. For shorter lengths of documents 12, the carriages 90 and 92 would be moved closer to the backstops 46 and 48, which has the effect of shortening the pockets 14 and 16, and moving the retainment fingers 58 and 60 closer to the usual backstops 48 and 46 respectively.

The use of the two pockets 14 and 16 allows for greater time advantage for making the right angle turn of the documents 12 from the vertical orientation to the horizontal orientation. By overlapping the time sequence of these pockets 14 and 16, a greater time is developed for the realignment and arming of the documents 12. Another significant advantage of the two pocket system is that errors in the delivery of documents 12 from the upstream, vertical paper transport or the horizontal transport 74 can be accommodated within a window of time in the document assembler 10. The dual pockets 14 and 16 also enhance the window for nipping and arming of documents 12 which provides proper document control for accurate merging.

It should be understood by those skilled in the art that various modifications may be made in the present invention without departing from the spirit and scope thereof, as described in the specification and defined in the appended claims.

What is claimed is:

1. Apparatus for merging vertically oriented documents with horizontally oriented documents, comprising:

a document assembler for receiving vertically oriented documents, said document assembler having a pair of parallel paper paths, each of said paper paths including means for transporting said vertically oriented documents to the end of said paper paths, means for stopping said vertically oriented documents at said end of each of said paper paths, and means for aligning said stopped documents at said end of each of said paper paths;

means located beneath said document assembler for re-orienting said documents from said document assembler from a vertical orientation to a horizontal orientation; and means located beneath said re-orienting means for transporting horizontally oriented documents toward the re-oriented documents emerging from said re-orienting means, whereby said horizontally oriented documents are merged with said re-oriented documents from said documents assembler.

2. The apparatus of claim 1, wherein said re-orienting means comprises a pair of belts.

3. The apparatus of claim 2, wherein each of said paper paths includes a pair of D-shaped, compliant nip rollers for receiving said vertically oriented document, said nip rollers engaging said vertically oriented documents that have reached said end of each of said paper paths.

4. The apparatus of claim 3, wherein each of said paper paths includes a pivotable, horizontal floor located beneath said compliant nip rollers, said floor engaging said vertically oriented documents that have reached said end of each of said paper paths.

5. The apparatus of claim 4, wherein said stopping means comprises a material having low values of restitution to minimize bounceback of said documents.

6. The apparatus of claim 5, wherein the aligning means comprises a retainment finger for urging said vertically oriented documents against said stopping means, said aligning means engaging said vertically oriented documents that have reached said end of each of said paper paths.

7. A method of merging vertically oriented documents with horizontally oriented documents, comprising:

feeding vertically oriented documents to a document assembler having a pair of parallel paper paths;

feeding said vertically oriented documents alternately through each of said paper paths;

stopping said vertically oriented documents at the end of each of said paper paths;

aligning said stopped documents at the end of each of said paper paths;

dropping said aligned, vertically oriented documents below each of said paper paths;

re-orienting said vertically oriented documents to a horizontal orientation; and feeding horizontally oriented documents toward said re-oriented documents to merge said horizontal documents with said re-oriented documents.

* * * * *